US009720428B2

(12) United States Patent
Suzuki

(10) Patent No.: US 9,720,428 B2
(45) Date of Patent: Aug. 1, 2017

(54) VOLTAGE REGULATOR

(71) Applicant: SII Semiconductor Corporation, Chiba-shi, Chiba (JP)

(72) Inventor: Teruo Suzuki, Chiba (JP)

(73) Assignee: SII Semiconductor Corporation, Chiba-Shi, Chiba (JP)

( * ) Notice: Subject to any disclaimer, the term of this patent is extended or adjusted under 35 U.S.C. 154(b) by 0 days.

(21) Appl. No.: 15/013,345

(22) Filed: Feb. 2, 2016

(65) Prior Publication Data

US 2016/0226378 A1 Aug. 4, 2016

(30) Foreign Application Priority Data

Feb. 4, 2015 (JP) ..... 2015-020601

(51) Int. Cl.
*G05F 1/565* (2006.01)

(52) U.S. Cl.
CPC ..... *G05F 1/565* (2013.01)

(58) Field of Classification Search
CPC ..... G05F 1/10; G05F 1/46; G05F 1/56; G05F 1/561; G05F 1/562; G05F 1/563; G05F 1/565; G05F 1/569; G05F 1/571; G05F 1/573; G05F 1/575; G05F 1/59; G05F 1/595; G05F 1/461; G05F 1/462; H02M 3/156; H02M 3/158; H02M 3/1588; H02M 2003/1566; H02M 2001/0016; H02M 2001/0025; H02M 3/155; H02M 3/1563; H02M 2001/0032
USPC ..... 323/222–226, 271–276, 280–285, 303, 323/351, 908, 311–317; 363/50–58; 330/252–261, 291, 292; 327/551–559
See application file for complete search history.

(56) References Cited

U.S. PATENT DOCUMENTS

2009/0001953 A1* 1/2009 Huang ..... G05F 1/575 323/281
2011/0156674 A1* 6/2011 Lin ..... G05F 1/575 323/282
2014/0117952 A1* 5/2014 Li ..... G05F 1/565 323/271

FOREIGN PATENT DOCUMENTS

JP 2007-280025 A 10/2007

* cited by examiner

*Primary Examiner* — Timothy J Dole
*Assistant Examiner* — Carlos Rivera-Perez
(74) *Attorney, Agent, or Firm* — Brinks Gilson & Lione

(57) ABSTRACT

Provided is a voltage regulator having excellent transient response characteristics. The voltage regulator includes: a first switch connected between a gate of an output transistor and a phase compensation capacitor; a voltage follower having an input terminal connected to an output terminal of a differential amplifier; a second switch connected between an output terminal of the voltage follower and the phase compensation capacitor; and a comparator configured to compare a reference voltage and a feedback voltage. The first switch and the second switch are controlled with an output signal of the comparator.

2 Claims, 2 Drawing Sheets

VOLTAGE REGULATOR

RELATED APPLICATIONS

This application claims priority under 35 U.S.C. §119 to Japanese Patent Application No. 2015-020601 filed on Feb. 4, 2015, the entire content of which is hereby incorporated by reference.

BACKGROUND OF THE INVENTION

1. Field of the Invention

The present invention relates to a voltage regulator configured to generate a constant output voltage based on an input voltage, and more particularly, to a technology for suppressing overshoot of an output voltage.

2. Description of the Related Art

In general, a voltage regulator is configured to generate a constant output voltage Vout at an output terminal based on an input voltage Vin that is input to an input terminal.

FIG. 2 is a circuit diagram of a related-art voltage regulator.

A bleeder resistor circuit 24 is configured to divide the output voltage Vout to generate a feedback voltage Vfb. A reference voltage circuit 23 is configured to output a reference voltage Vref. A differential amplifier 21 has an input terminal, to which the reference voltage Vref and the feedback voltage Vfb are input, and an output terminal connected to a gate of a MOS transistor 25. An output voltage detection circuit 26 has an input terminal connected to an output terminal of the voltage regulator, and an output terminal connected to a current source 22 configured to cause a bias current to flow through a differential amplifier 21.

Operation of the related-art voltage regulator is described.

When the reference voltage Vref is larger than the feedback voltage Vfb, an output of the differential amplifier 21 is low. Consequently, an ON resistance of the MOS transistor 25 becomes smaller, and the output voltage Vout of the voltage regulator thus becomes higher. That is, the voltage regulator is operated so that the feedback voltage Vfb and the reference voltage Vref may become equal to each other. When the feedback voltage Vfb is larger than the reference voltage Vref, operation reverse to the above-mentioned operation is performed, and hence the output voltage Vout becomes low. The voltage regulator is configured to keep the feedback voltage Vfb and the reference voltage Vref equal to each other all the time, to thereby output the constant output voltage Vout.

When the input voltage is transitionally increased, a gate voltage of the MOS transistor 25 follows the input voltage with a lag of time t, and hence a voltage difference between the gate voltage and a source voltage of the MOS transistor 25 is increased, with the result that overshoot occurs in the output voltage Vout of the voltage regulator.

The output voltage detection circuit 26 is configured to monitor the output voltage Vout. When overshoot occurs in the output voltage Vout, the output voltage detection circuit 26 outputs a detection signal to the current source 22 to cause the current source 22 to increase a bias current flowing through the differential amplifier 21. Thus, transient response characteristics of the differential amplifier 21 are improved, to thereby suppress the overshoot of the output voltage Vout (for example, see Japanese Patent Application Laid-open No. 2007-280025).

However, in the related-art voltage regulator, the gate voltage of the MOS transistor 25 is controlled with a higher voltage because the current of the current source 22 is increased.

Consequently, in the related-art voltage regulator, the gate voltage of the MOS transistor 25 is increased to be a steady operation voltage or more, and hence there is a problem in that undershoot occurs immediately after the overshoot is suppressed.

SUMMARY OF THE INVENTION

The present invention has been made in view of the above-mentioned problem, and provides a voltage regulator including an overshoot suppression circuit, in which no undershoot occurs.

In order to solve the above-mentioned problem, according to one embodiment of the present invention, there is provided a voltage regulator including: a first switch connected between a gate of an output transistor and a phase compensation capacitor; a voltage follower having an input terminal connected to an output terminal of a differential amplifier; a second switch connected between an output terminal of the voltage follower and the phase compensation capacitor; and a comparator configured to compare a reference voltage and a feedback voltage, the first switch and the second switch being controlled with an output signal of the comparator.

According to the voltage regulator of the one embodiment of the present invention, the phase compensation capacitor is disconnected, thereby being capable of quickly suppressing overshoot of an output voltage, and suppressing undershoot. Moreover, the phase compensation capacitor is precharged by the voltage follower so as to have the same potential as an output voltage of the differential amplifier while the phase compensation capacitor is being disconnected, and hence the output voltage is stable even when the switches are switched.

DETAILED DESCRIPTION OF THE PREFERRED EMBODIMENTS

Figure 1:
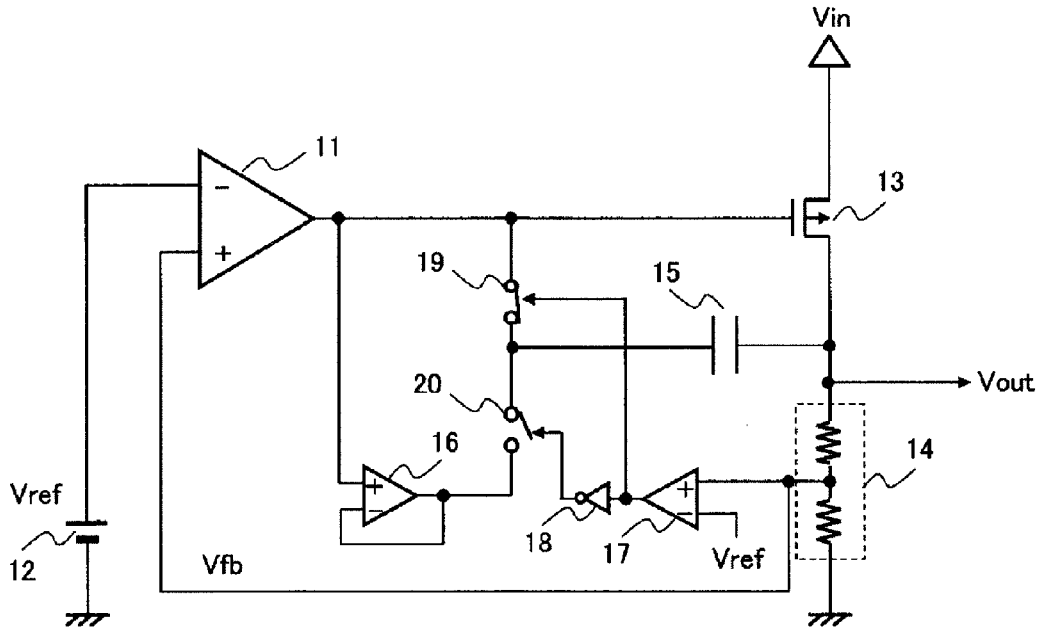
FIG. 1 is a circuit diagram for illustrating a voltage regulator according to an embodiment of the present invention.
Figure 2:
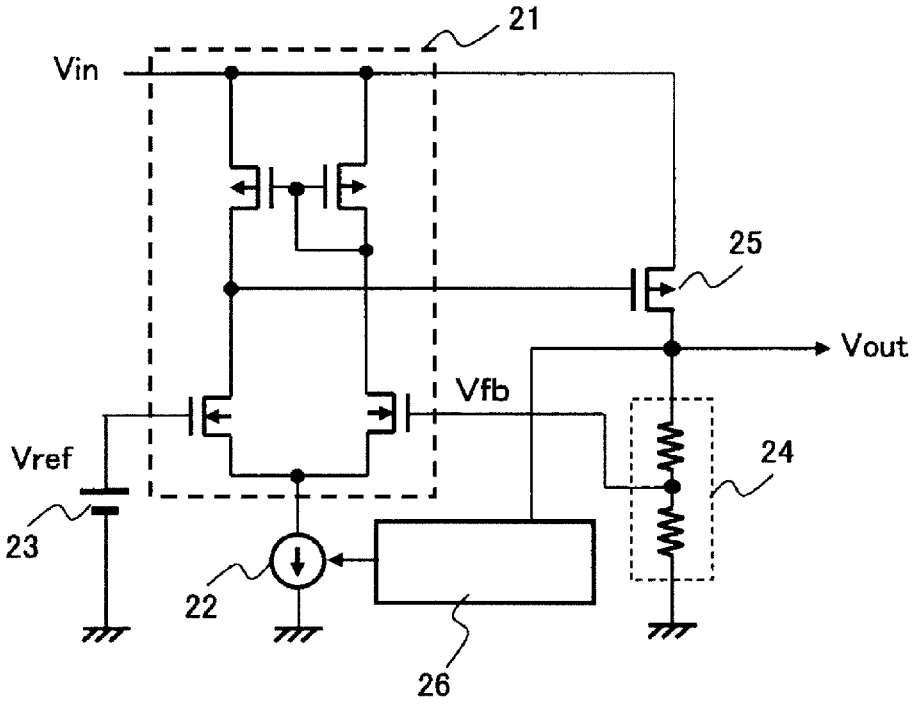
FIG. 2 PRIOR ART
FIG. 2 is a circuit diagram for illustrating a related-art voltage regulator.

FIG. 1 is a circuit diagram for illustrating a voltage regulator according to an embodiment of the present invention.

The voltage regulator of this embodiment includes a differential amplifier 11, a reference voltage circuit 12, a MOS transistor 13 serving as an output MOS transistor, a bleeder resistor circuit 14, a capacitor 15 for phase compensation, a voltage follower 16, a comparator 17, an inverter 18, and switches 19 and 20.

The MOS transistor 13 is connected between an input terminal and an output terminal of the voltage regulator. The bleeder resistor circuit 14 is connected between the output terminal of the voltage regulator and a ground terminal. The differential amplifier 11 has an inverting input terminal connected to an output terminal of the reference voltage circuit 12, a non-inverting input terminal connected to an output terminal of the bleeder resistor circuit 14, and an output terminal connected to a non-inverting input terminal of the voltage follower 16 and a gate of the MOS transistor 13. The switch 19 and the switch 20 are connected in series between the output terminal of the differential amplifier 11 and an output terminal of the voltage follower 16. The capacitor 15 is connected between a node of the switch 19 and the switch 20 and the output terminal of the voltage regulator. The comparator 17 has a non-inverting input terminal connected to the output terminal of the bleeder resistor circuit 14, and an inverting input terminal connected to the output terminal of the reference voltage circuit 12. A control terminal of the switch 19 is connected to an output terminal of the comparator 17. A control terminal of the switch 20 is connected to the output terminal of the comparator 17 via the inverter 18.

The bleeder resistor circuit 14 divides an output voltage Vout to generate a feedback voltage Vfb. The reference voltage circuit 12 outputs a reference voltage Vref. The differential amplifier 11 has input terminals to which the reference voltage Vref and the feedback voltage Vfb are input, and compares the reference voltage Vref and the feedback voltage Vfb to each other.

Next, operation of the voltage regulator of this embodiment is described.

When an input voltage Vin is suddenly increased, a source voltage of the MOS transistor 13 is also increased. At this time, a gate voltage of the MOS transistor 13 is an output voltage of the differential amplifier 11, which does not follow a change in the input voltage Vin. Consequently, a gate-source voltage of the MOS transistor 13 is increased, and an ON resistance thereof is thus reduced. Then, the output voltage Vout of the voltage regulator is increased, and the feedback voltage Vfb is also increased.

In this case, when the feedback voltage Vfb is larger than the reference voltage Vref, the comparator 17 controls the switch 19 to be opened, and controls the switch 20 to be closed. Thus, the voltage follower 16 precharges the capacitor 15 via the switch 20 so that the capacitor 15 may have the same potential as the output voltage of the differential amplifier 11.

Moreover, the gate voltage of the MOS transistor 13 can quickly follow the output voltage of the differential amplifier 11 because the switch 19 is opened and the capacitor 15 is thus disconnected. Consequently, overshoot of the output voltage Vout of the voltage regulator can be quickly suppressed. At this time, the gate voltage of the MOS transistor 13 is controlled with the output voltage of the differential amplifier 11, which has the same value as the output voltage in a state in which a bias current is normal. Thus, undershoot hardly occurs in the output voltage Vout of the voltage regulator.

After that, the output voltage Vout of the voltage regulator reaches a desired voltage, and the feedback voltage Vfb and the reference voltage Vref become equal to each other. Then, the switch 19 is controlled to be closed and the switch 20 is controlled to be opened with the output signal of the comparator 17. At this time, the capacitor 15 has been precharged by the voltage follower 16 to have the same potential as the output voltage of the differential amplifier 11 in advance, and hence the gate voltage of the MOS transistor 13 is not affected when the switch 19 is closed. Consequently, even when the switch 19 and the switch 20 are switched, the output voltage Vout of the voltage regulator can be stably output as the desired voltage.

As described above, according to the voltage regulator of this embodiment, the phase compensation capacitor is disconnected, thereby being capable of quickly suppressing the overshoot of the output voltage, and suppressing the undershoot. Moreover, the phase compensation capacitor is precharged by the voltage follower so as to have the same potential as the output voltage of the differential amplifier 11 while the phase compensation capacitor is being disconnected, and hence the output voltage is stable even when the switches are switched.

What is claimed is:

1. A voltage regulator, comprising:

a differential amplifier configured to amplify a difference between a reference voltage and a feedback voltage, to thereby output the amplified difference;

an output transistor having a gate connected to an output terminal of the differential amplifier;

a phase compensation capacitor connected between the gate and a drain of the output transistor;

a first switch connected between the gate of the output transistor and the phase compensation capacitor;

a voltage follower having an input terminal connected to the output terminal of the differential amplifier;

a second switch connected between an output terminal of the voltage follower and the phase compensation capacitor, wherein the voltage follower has the output terminal connected to the second switch such that the phase compensation capacitor is precharged to have the same potential as the output voltage of the differential amplifier; and a comparator configured to compare the reference voltage and the feedback voltage, the comparator coupled to both the first switch and the second switch, the first switch and the second switch being controlled with an output signal of the comparator.

2. The voltage regulator according to claim 1, wherein the first switch is turned off and the second switch is turned on when the feedback voltage becomes higher than the reference voltage.

* * * * *